US006786828B2

(12) United States Patent
Sørensen

(10) Patent No.: US 6,786,828 B2
(45) Date of Patent: Sep. 7, 2004

(54) METHOD OF FASTENING A TOOL IN A TOOL HOLDER

(76) Inventor: Svend-Helge Sell Sørensen, Rugbjergvej 49, DK-8260 Viby J (DK)

( * ) Notice: Subject to any disclaimer, the term of this patent is extended or adjusted under 35 U.S.C. 154(b) by 0 days.

(21) Appl. No.: 10/123,229

(22) Filed: Apr. 17, 2002

(65) Prior Publication Data

US 2003/0196473 A1 Oct. 23, 2003

(51) Int. Cl.[7] ..... B21J 13/02

(52) U.S. Cl. ..... 470/192; 470/195; 470/121; 470/207; 72/482.3

(58) Field of Search ..... 72/478, 482.3; 470/144, 195, 207, 121, 192, 156; 403/381

(56) References Cited

U.S. PATENT DOCUMENTS

| | | | | | |
|---|---|---|---|---|---|
| 1,578,351 | A | * | 3/1926 | Nullmeyer | 72/463 |
| 2,178,711 | A | * | 11/1939 | Werner | 470/125 |
| 3,965,716 | A | * | 6/1976 | Suzuki et al. | 72/356 |
| 4,520,701 | A | * | 6/1985 | Watamura | 82/158 |
| 5,014,540 | A | * | 5/1991 | Ferrante | 72/482.3 |
| 5,979,216 | A | * | 11/1999 | Schretter et al. | 72/478 |
| 6,110,047 | A | * | 8/2000 | Lin | 470/65 |
| 2003/0032489 | A1 | * | 2/2003 | Hurst et al. | 470/195 |

FOREIGN PATENT DOCUMENTS

| | | |
|---|---|---|
| EP | 0 406 202 A2 | 6/1990 |
| EP | 0 879 558 A2 | 10/1998 |

* cited by examiner

*Primary Examiner*—Allen Ostrager
*Assistant Examiner*—John S Goetz
(74) *Attorney, Agent, or Firm*—Dykema Gossett PLLC

(57) ABSTRACT

The present invention is for a method of fastening a tool holder. The tool (2) has a front side (6) shaped for use in cold forming of metal wire into nails, screws, etc. The tool holder (4) has a recess (8) shaped for receiving the tool (2). When the tool (2) is fastened in the tool holder (4), compressive stresses are initially present in the tool (2). The tool (2) is subjected to tensile stresses caused by the nail making process when in the tool holder (4). In order to reduce the resulting tensile stresses, the two opposite and wedge-shaped sides (10, 12) of the tool (2) are compressed against corresponding sides (14, 16) in the recess (8) by applying and maintaining pressure on the back side (18) of the tool with fastening means (20).

11 Claims, 4 Drawing Sheets

METHOD OF FASTENING A TOOL IN A TOOL HOLDER

The present invention relates to a method of fastening a tool in a tool holder, the tool comprises a front side shaped for use in cold forming of metal wire into nails, screws, etc. The tool holder comprises a recess shaped for receiving the tool. The invention is directed to a tool system comprising a tool and a tool holder, and further to the use of a tool and a tool holder.

Other methods of fastening a tool in a tool holder and devices with such purpose have formerly been employed. In EP 406,202 A2 a clamping device for making nails is disclosed, where a die (tool) is mounted in a die holder. The die holder is provided with an opening for receiving the die. The back side of the opening is provided with an extension to obtain a slight elasticity, and across said extension a bolt is mounted to clamp the die in the die holder. However, the force from the bolt is relatively small compared to the forces exerted on the die during the nail making process. The tensile stresses in the die are relatively large, and over the life span of the die numerous stresses are applied and relieved such that the well known phenomena of metal fatigue appears. This often to cracked dies which have to be replaced, leading to extra costs and lost production output due to lost time.

The problem is addressed in EP 870,558 A2 and the corresponding U.S. Pat. No. 5,979,216, where the tool insert (die/tool) has been divided in two parts in order to remove harming effects of tensile stresses, i.e., providing a crack in a determined position. The solution is costly, since more parts, which must fit accurately together, have to be made.

Also another phenomena known as fretting may appear, which leads to deterioration of the tool inserts. The presence of fretting is caused due to the bolt, which is also employed in this technique, being inadequate to provide sufficient clamping force. With inadequate clamping force, the two parts on each side of the artificial crack are moving slightly away from each other during each loading cycle, and back when the load is removed. The slight movement causes wear and consequently fretting.

The basic problem has not been solved, namely that the tool insert (die/tool) is subject to tensile stresses that are too high. When cold forming a wire, the shaping portion of the tool is subject to a high pressure which is substantially radially directed on the concave shaping portion of the tool. The pressure results in compressive stresses near the surface, where the contact is between the tool and the wire. However, slightly further away from the surface, tangentially oriented to the concave shaping portion, tensile stresses prevail.

In case of a flat shaping portion, the pressure also results in compressive stresses near the surface, where the contact is between the tool and the wire. Slightly further away from the surface, tangentially oriented to the origin of contact, tensile stresses also prevail.

One object of the present invention is to provide a method of fastening a tool in a tool holder, such that compressive stresses are initially present in the tool (built-in) when the tool is subjected to the tensile stresses caused by the nail/screw making process. Such method will reduce the resulting tensile stresses.

Another object is to improve the life span of the tool and further to reduce down time in the production.

The new and inventive aspects of the method according to the invention comprise a tool with two opposite sides forming a wedge-shape which are narrowing towards the front side of the tool. The recess in the tool holder comprises two corresponding sides which are placed substantially in the same wedge-shape. The tool has a back side and is fastened by placing the tool in the recess and displacing the tool substantially in the direction of the front side. Then the two opposite sides of the tool are compressed against the corresponding sides of the recess by applying and maintaining pressure on the back side of the tool with fastening means.

By the new and inventive aspects it is obtained, that the tool is compressed between the two opposite sides of the recess, such that compressive stresses are introduced in the tool. Due to the wedge-shape of the tool and the recess, the amount of pressure applied to the back side is amplified several times on the sides of the tool, whereby the compressive stresses reach a high level introduced and maintained by the fastening means. When the tool is afterwards used in the nail/screw making process, the tensile stresses caused thereby, must relieve or overcome the compressive stresses before a state of tensile stress in the tool can be present. Hence, the resulting tensile stress level is at least partly reduced, and may be avoided.

The two opposite sides may further be formed with a wedge-shape relative to a bottom side of the recess. The wedge-shape is narrowing away from the bottom side. The two corresponding sides in the recess in the tool holder are placed in substantially the same wedge-shape, and the tool is fastened against the bottom side of the recess by applying and maintaining pressure on the back side with fastening means. A considerable compression may be obtained similarly to the effect obtained as mentioned and explained above, however in a substantially perpendicular direction. The perpendicular direction is parallel to the direction of another force present in the nail/screw making process. This other force is caused when forming the flat head on the nail or screw. The force introduces shear as well as tensile stresses near and on the surface portion of the tool in contact with the metal wire. A prestressed compression will also reduce the maximum tensile stresses and improve the life span of the tool.

The fastening means may have a back side that is sloped relative to the bottom side of the recess. A wedge with a hole can be placed with one side against the back side. A bolt is connected to the tool holder through the hole pressure may be applied and maintained on the back side by tightening the bolt against the wedge. Hereby a way of amplifying the force from the bolt is obtained, which also further amplifies the compression in the tool.

The new and inventive aspects of the tool system, according to the invention, include the tool having two opposite sides forming a wedge-shape, which narrows towards the front side of the tool. The recess in the tool holder comprises two corresponding sides which are placed substantially in the same wedge-shape. The tool also has a back side that is sloped relative to the bottom side of the recess. A wedge is placed with one side against the back side and the opposite side against an end side of the recess. The wedge comprises a hole through which a bolt is connected to the tool holder. The tool is fastened by tightening the bolt against the wedge.

The tool is compressed between the two opposite sides of the recess, such that compressive stresses are introduced in the tool. Due to the wedge-shape of the two sides, the pressure applied to the back side is amplified several times, whereby the compressive stresses reach a high level. Also the force from the bolt is amplified thereby allowing the compressive stresses to be further increased. An advantage of this system is that the tool may be replaced without having to disconnect the tool holder from the machine since the tool and the fastening means may all be reached from the same accessible side.

The two opposite sides may further be formed with a wedge-shape relative to the bottom side of the recess. The wedge-shape is narrowing away from the bottom side. The two corresponding sides in the recess in the tool holder are placed in substantially the same wedge-shape. As such, the harmful effects from the shear as well as tensile stresses near the contact portion of the tool from the making of the nail/screw head may be reduced. A prestressed state of compression will also reduce the maximum tensile stresses and improve the life span of the tool.

The angle of the wedge-shape narrowing towards the front side of the tool may be between 0.5 and 45 degrees in an alternative embodiment of the present invention.

In yet another embodiment, the angle may be between 1 and 15 degrees

In a further embodiment, the angle of the wedge-shape narrowing away from the bottom side of the recess may be between 1 and 30 degrees.

The new and inventive aspects of the tool according to the invention are the two opposite sides forming a wedge-shape which narrows towards the front side of the tool. The tool is configured for fastening in a tool holder having a recess adapted for receiving the tool. The tool also has fastening means for fastening the tool by application and maintenance of pressure on the tool in a way such that the two opposite sides may be pre-stressed in the recess. The tool may be fastened in a tool holder so that tensile stresses in the tool are reduced and the life span of the tool is increased.

The tool holder is adapted for receiving and fastening a wedge-shaped tool for use in cold forming of metal wire into nails, screws, etc. The tool holder comprises a recess shaped for receiving the tool. The recess in the tool holder has two sides forming a wedge-shape which narrows towards an open end of the recess. The tool holder has fastening means configured for fastening the tool by application and maintenance of pressure on the tool, in a way such that the tool may be pre-stressed in the recess against the sides. As such, the tool holder may receive and fasten a tool, in a way such that the life span of the tool is increased.

The tool and the tool holder are used in a machine or plant in a process for the manufacture of nails, screws and similar items so as to decrease production time.

In the following invention is further explained with the use of drawings, where examples of embodiments are shown.

Figure 1:
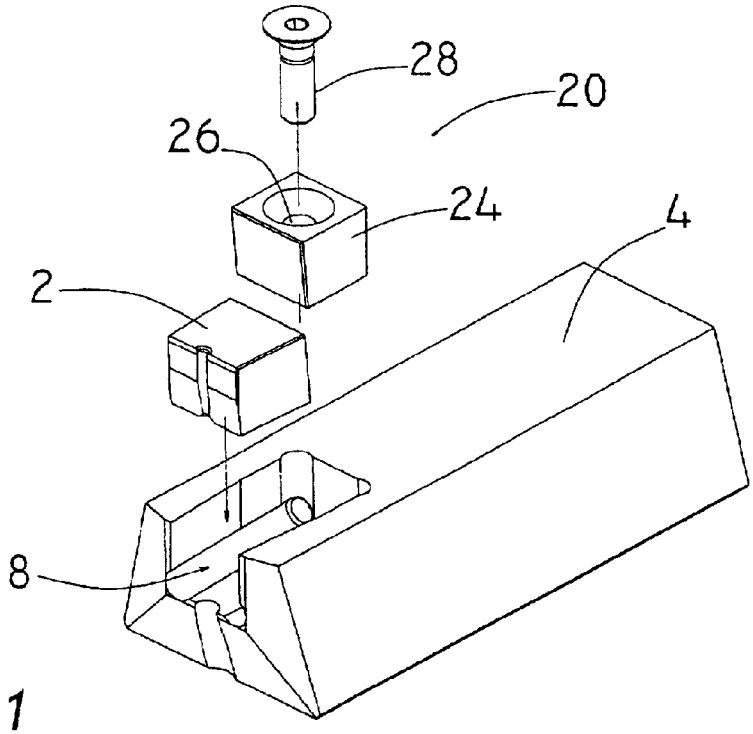
FIG. 1 is an exploded perspective view of a tool system.

In FIG. 1 a tool holder 4 with a wedge-shaped recess 8. A tool 2 can be placed in the recess 8 and fastened by fastening means 20, which in this example comprise a wedge 24 with a hole 26 and a bolt 28. The bolt 28 is to be engaged with an threaded hole in the bottom of the recess 8 (not shown).

Figure 2:
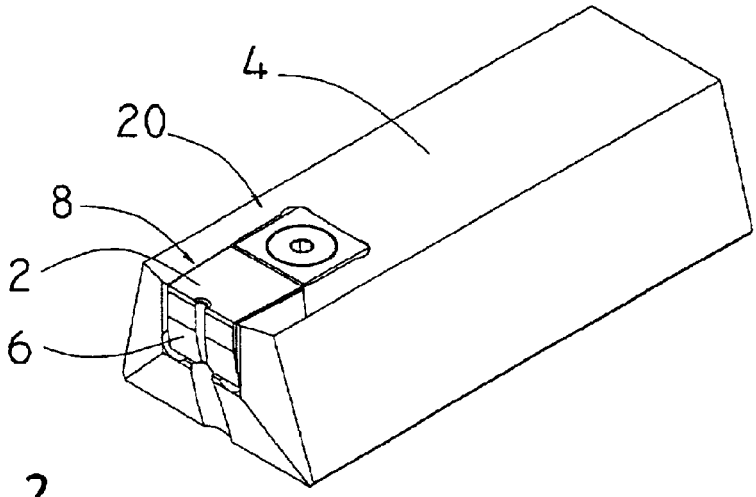
FIG. 2 is a perspective view of a tool system.
Figure 3:
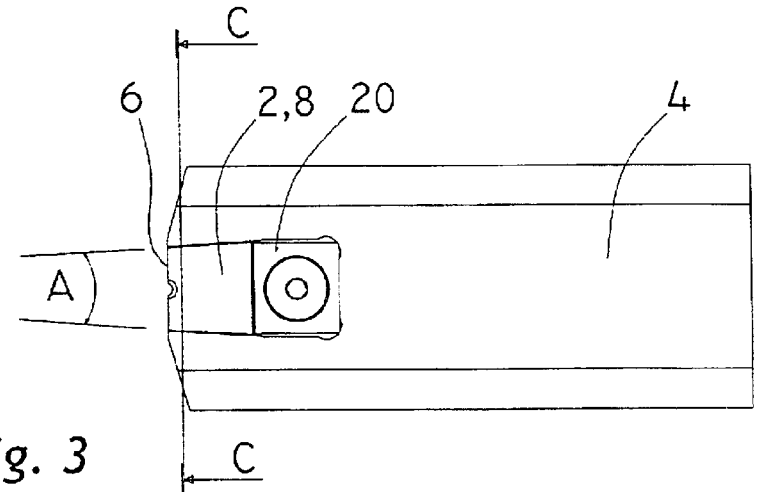
FIG. 3 is a top plan view of a tool system.
Figure 4:
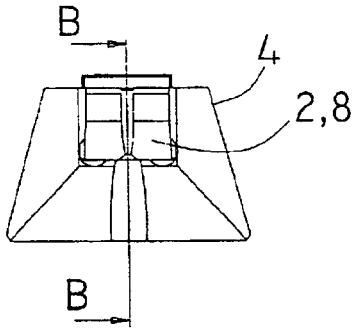
FIG. 4 is a front elevation view of a tool system.

In FIGS. 2–4 a tool 2 is fastened by fastening means 20 in a wedge-shaped recess 8 of a tool holder 4. The wedge-shape is indicated by an angle A (FIG. 3). The tool comprises a front side 6 shaped for use in cold forming of metal wire into nails, screws or similar products. The tool 2 may be made of a hardened metal alloy.

In FIG. 3 angle A refers to the wedge-shape of the recess 8. Preferably, the tool 2 is provided with a similar wedge-shape. The fastening means 20 press the tool 2 towards the narrow end of the recess 8 in order to compress the tool 2 against the recess 8. The fastening means 20, 24, 26, 28 shown in FIGS. 1–3 are for a skilled person easily substituted, e.g. with bolt through the tool holder 4 in the longitudinal direction, pressing directly on the tool 2, or a hydraulic cylinder built into the holder 4 etc.

Figure 5:
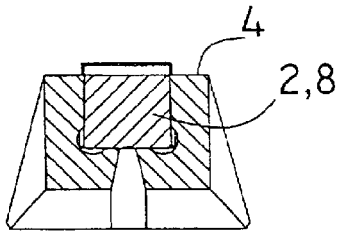
FIG. 5 is a cross-sectional view of a tool system taken along the line C—C of FIG. 3.

FIG. 5 show a cross-section in a tool 2 placed in a recess 8 in a holder 4. As displayed, the tool 2 and the recess 8 are fitted closely.

Figure 6:
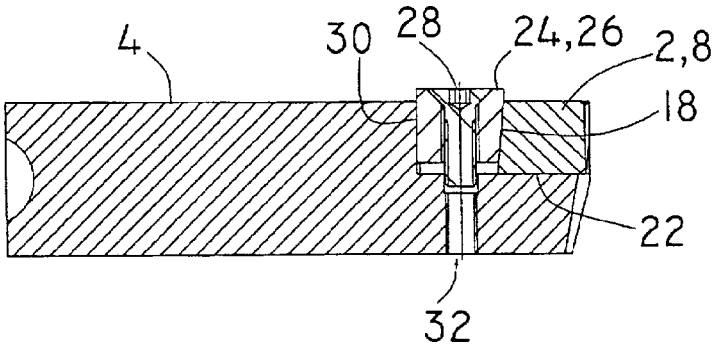
FIG. 6 is a cross-sectional view of a tool system taken along the line B—B of FIG. 4.

FIG. 6 shows another cross-section in a tool 2 and a tool holder 4. Pressure is exerted on a back side 18 of the tool 2 by a wedge 24. The back side 18 is sloped relative to a bottom 22 of the recess. The wedge 24 comprises a shape corresponding to the sloped shape on one side and a shape corresponding to an end side 30 of the recess. The end side 30 may be placed at a right angle to the bottom side 22 or at an angle. The wedge 24 comprises a through-going hole 26, through which a bolt 28 may be inserted and engaged with a threaded hole 32 in the holder 4. At first the tool 2 is placed in a recess 8, after which the wedge 24 is inserted between the tool 2 and the end side 30. Thereafter the bolt 28 is inserted and engaged with the threaded hole 32 and tightened. The tightening of the bolt 28 forces the wedge 24 downwards, whereby a high force is directed on the sloped back side 18 of the tool 2, the high force compressing the tool forwards against the recess 8.

Figure 7:
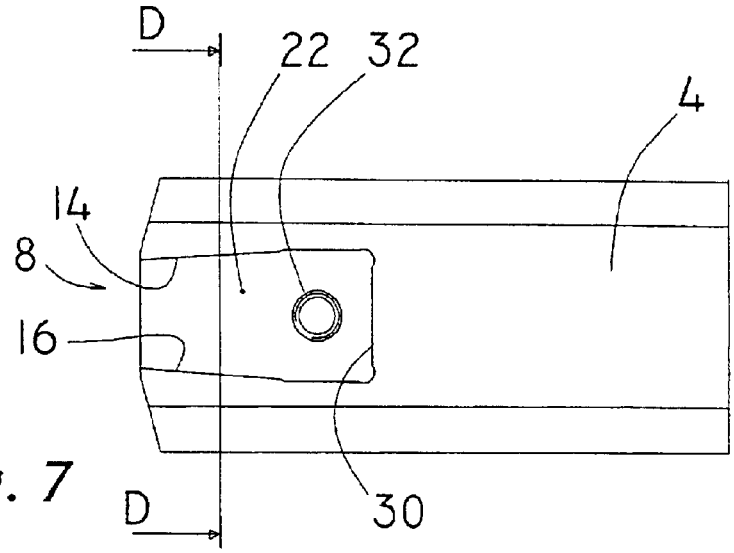
FIG. 7 is a top plan view of a tool holder.

In FIG. 7 a tool holder 4 is shown. The holder comprises a wedge-shaped recess 8 with two sides 14, 16 and an end side 30. A bottom side 22 of the recess is provided with a threaded hole 32.

Figure 8:
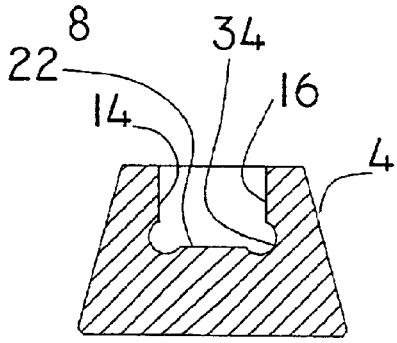
FIG. 8 is a cross-sectional view of a tool system taken along the line of D—D of FIG. 7.

FIG. 8 is a cross-section view taken along lines D—D from FIG. 7. The two sides 14 and 16 may be placed at right angles with a bottom side 22 of a recess 8. The transition between the side 14 and the bottom side 22, and the side 16 and the bottom side 22 respectively may be provided with an undercut fillet 34 to reduce local stress levels and to ensure that sufficient space is available for a tool.

Figure 9:
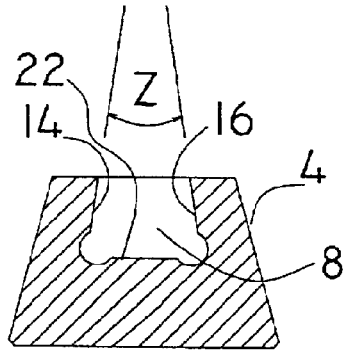
FIG. 9 is a cross-sectional view of another embodiment of a tool holder.

In FIG. 9 it is shown that the two sides 14, 16 may also be placed to form a wedge-shape with an angle Z. The wedge-shape is suited to compress a tool with a force component downwardly against the bottom side 22. As such, both a compression in a plane parallel to the bottom side 22, as well as in a plane perpendicular to the bottom side 22, may be obtained. This provides a tool 2 with built-in compressive stresses that have to be overcome before a state of tensile stress may appear. Tensile stresses, which are present from forces exerted on the front side 6 of a tool 2 from using the tool, will be reduced by the built-in compressive stresses. For example, the magnitude of the tensile stresses actually occurring in the tool 2 are reduced or removed.

Figure 10:
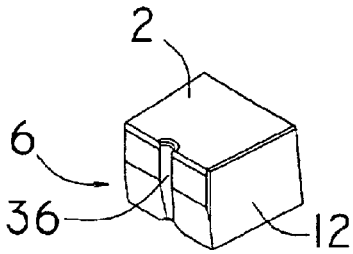
FIG. 10 is a perspective view of a tool.

FIG. 10 shows a tool 2 comprising a side 12 and a front side 6 with a concave shaping portion 36 for shaping a nail or screw etc.

Figure 11:
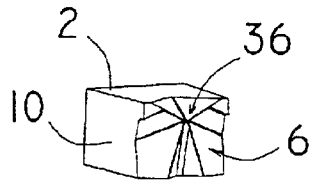
FIG. 11 is a perspective view of another embodiment of a tool.

FIG. 11 shows a different or counteracting tool 2 comprising a side 10 and a front side 6 with a shaping portion 36.

Figure 12:
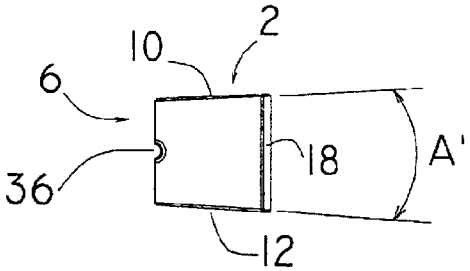
FIG. 12 is a top plan view of a tool.

FIG. 12 is a top plan view of a tool 2 with a front side 6 comprising a shaping portion 36, the shaping portion 36 being concave. The tool 2 has two sides 10 and 12 forming a wedge-shape due to the two sides 10, 12 being placed at an angle A'. The angle A of FIG. 3 and the angle A' are preferably substantially corresponding.

Figure 13:
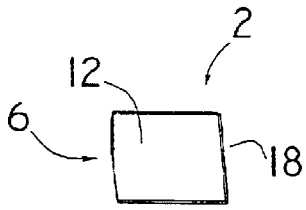
FIG. 13 is a side elevation view of a tool.

In FIG. 13 a tool 2 is shown comprising a front side 6, a side 12 and a sloped back side 18.

Figure 14:
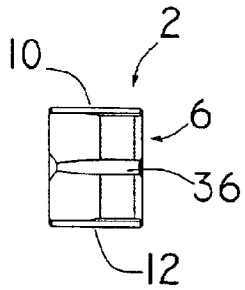
FIG. 14 is a front elevation view of a tool.

FIG. 14 is a front elevation view of an embodiment of a tool 2 with sides 10 and 12, and a front side 6 with a shaping portion 36.

Figure 15:
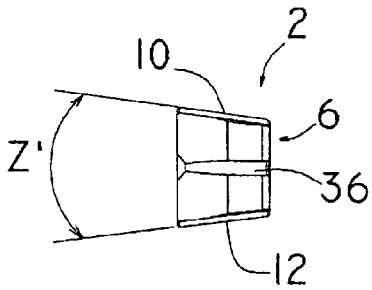
FIG. 15 is a front elevation view of another embodiment of a tool.

FIG. 15 displays another embodiment of a tool 2 with sides 10 and 12, and a front side 6 with a shaping portion 36. The two sides 10 and 12 are placed under an angle Z' to form a wedge-shape. The angle Z' is preferably substantially corresponding to the angle Z on FIG. 9.

What is claimed is:

1. A tool for use in cold forming of metal wire into nails and screws comprising a front side shaped for said use and an oppositely placed back side, wherein the tool has two opposite sides forming a wedge-shape that is narrower towards the front side of the tool and is formed with an angle between 0.5 and 45 degrees, the tool is configured for fastening in a tool holder having a recess for receiving the tool, and fastening means for fastening the tool by application and maintenance of pressure on the tool such that the two opposite sides may be pre-stressed in the recess.

2. Use of a tool according to claim 1 in a machine or plant in a process for the manufacture of nails, screws and similar items.

3. A tool holder for receiving and fastening a wedge-shaped tool for use in cold forming of metal wire into nails and screws, said tool holder comprises a recess shaped for receiving the tool, wherein the recess in the tool holder comprises two sides forming a wedge-shape that is narrower towards an open end of the recess and is formed with an angle between 0.5 and 45 degrees, the tool holder comprises fastening means configured for fastening the tool by application and maintenance of pressure on the tool so that the tool may be pre-stressed in the recess against the sides.

4. Use of a tool holder according to claim 3 in a machine or plant in a process for the manufacture of nails, screws, and similar items.

5. A tool system comprising a tool and a tool holder, said tool has a front side shaped for use in cold forming of metal wire into nails and screws, said tool holder comprises a recess shaped for receiving the tool, wherein the tool has two opposite sides forming a wedge-shape, said wedge-shape is narrower at the side located towards the front side of the tool and is formed with an angle between 0.5 and 45 degrees, the recess in the tool holder comprises two corresponding sides which are placed substantially in the same wedge-shape, the tool comprises a back side that is sloped relative to a bottom side of the recess, a wedge is placed with one side against the back side of the tool and the opposite side against an end side of the recess, said wedge comprises a hole, a bolt is connected to the tool holder through said hole, and the tool is fastened in the recess by tightening the bolt against the wedge.

6. A tool system according to claim 5, wherein the two opposite sides are formed with a wedge-shape relative to the bottom side of the recess, said wedge-shape is narrower on the side located away from said bottom side, and the two corresponding sides in the recess in the tool holder are placed in substantially the same wedge-shape.

7. A tool system according to claim 5, wherein the angle is between 1 and 15 degrees.

8. A tool system according to claim 6, wherein the wedge-shape that is narrower away from the bottom side is formed with an angle between 1 and 15 degrees.

9. A method of fastening a tool in a tool holder with fastening means, said tool comprises a front side shaped for use in a cold forming of metal wire and said tool holder comprises a recess shaped for receiving the tool, wherein the tool comprises a back side and two opposite sides forming a wedge-shape that is narrower at the side towards the front side of the tool, said wedge-shape being formed with an angle between 0.5 and 45 degrees, the recess in the tool holder comprises two corresponding sides placed substantially in the same wedge-shape, and wherein the method comprises the steps of:

placing the tool in the recess, displacing the tool substantially in the direction of the front side of the tool, and compressing the two opposite sides of the tool against the corresponding sides of the recess, and introducing compressive stresses between said two opposite sides in the tool by applying and maintaining pressure on the back side of the tool with the fastening means, said compressive stresses being introduced at least in a region by the front side of the tool.

10. A method according to claim 9, wherein the two opposite sides are formed with a wedge-shape relative to a bottom side of the recess, said wedge-shape is narrower at the side located away from said bottom side, the two corresponding sides in the recess in the tool holder being formed with substantially the same wedge-shape, and wherein the method comprises the step of fastening the tool against the bottom side of the recess by applying and maintaining pressure on the back side of the tool with the fastening means.

11. A method according to claim 9, wherein the region with compressive stresses introduced comprise at least the majority of the tool.

* * * * *